United States Patent [19]

Oostlander

[11] Patent Number: 4,688,863

[45] Date of Patent: Aug. 25, 1987

[54] METHOD AND APPARATUS FOR EARTHING A CONDUCTOR SUSPENDED BY A SUPPORTING CONSTRUCTION

[75] Inventor: Arie P. Oostlander, Rijsbergen, Netherlands

[73] Assignee: Rovee B.V., S-Hertogenbosch, Netherlands

[21] Appl. No.: 702,320

[22] Filed: Feb. 15, 1985

[30] Foreign Application Priority Data

Feb. 21, 1984 [NL] Netherlands ..... 8400547

[51] Int. Cl.[4] ..... H01R 4/66

[52] U.S. Cl. ..... 439/92; 29/854; 174/556; 439/815; 439/477

[58] Field of Search ..... 339/14 L, 253 L, 255 L, 339/203 L, 265 R, 260 L, 109, 12 G; 174/556, 6; 29/854

[56] References Cited

U.S. PATENT DOCUMENTS 4,097,108 6/1978 Prodel ..... 339/109

*Primary Examiner*—Eugene F. Desmond

*Attorney, Agent, or Firm*—John P. Snyder

[57] ABSTRACT

Method and an apparatus for earthing a conductor (4) suspended in the air by a supporting construction (8) wherein an earth cable (10) first is connected with an earth contact (13) on the supporting construction (8) and subsequently is connected to the conductor (4) to be earthed by means of an earth clip (7). By supplying a spring mechanism for tightening the clip (7) onto the conductor (4) to be earthed and by using the weight of the parts of the clip (7) urging it through a lever system (15) in the opened position while lowering the clip (4), an automatic light clip is provided.

10 Claims, 4 Drawing Figures

Figure 1:
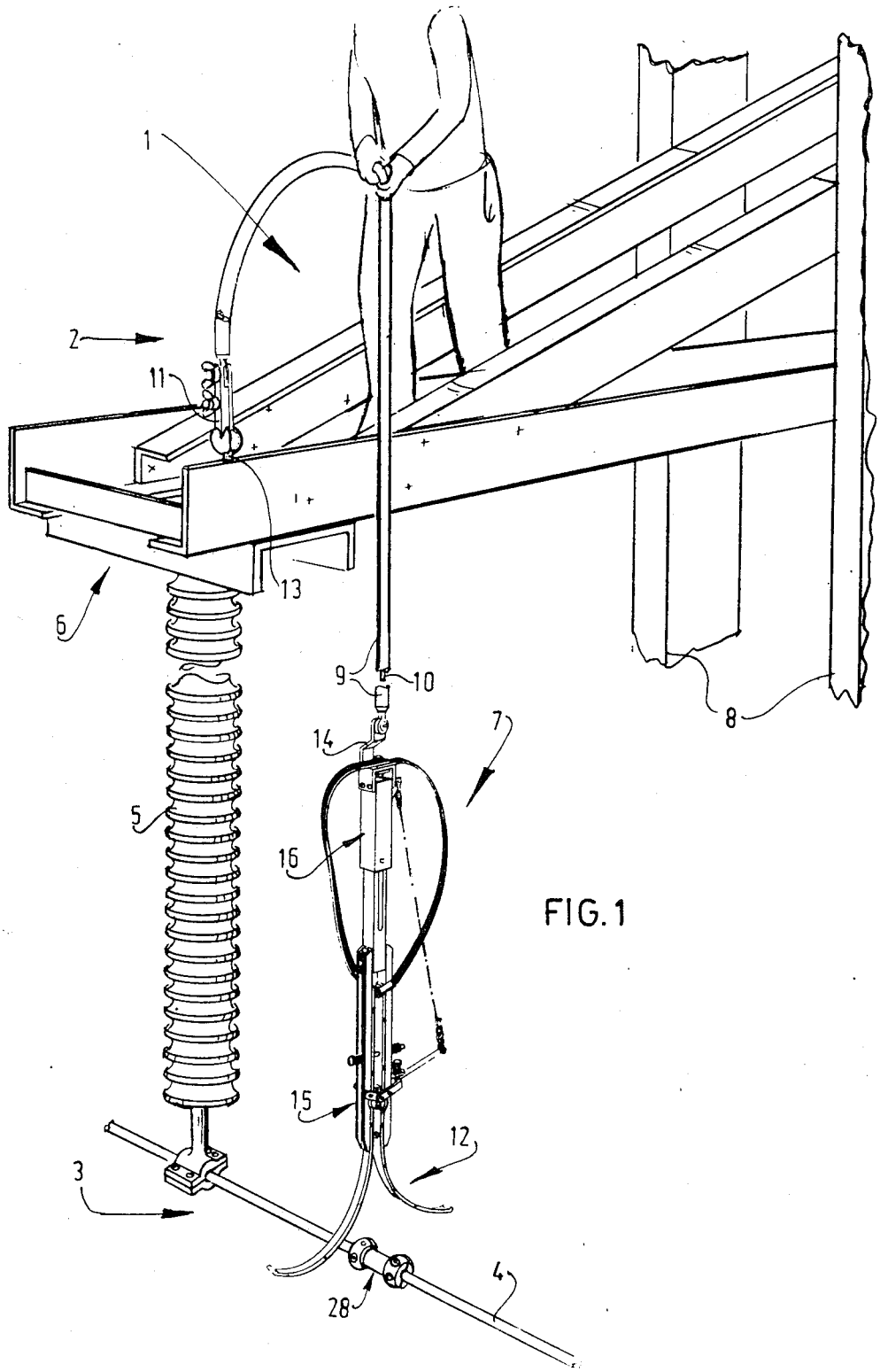

METHOD AND APPARATUS FOR EARTHING A CONDUCTOR SUSPENDED BY A SUPPORTING CONSTRUCTION

The present invention concerns a method for earthing a conductor suspended in the air by a supporting construction, wherein an earth cable first is connected with an earth contact on the supporting construction and subsequently is connected with the conductor to be earthed by means of an earth clip, wherein the earth clip tighteningly engages the conductor by means of tightening jaws in the earthing position and wherein the tightening jaws keep the earth clip open in the non-earthing position as a consequence of the weight of at least a part of the earth clip. A method of this kind is known from the French specification No. 875,997.

According to the known method of the kind mentioned above one climbs into the construction until close to the conductor to be earthed, whereafter one pulls up by means of a rope a rather heavy apparatus, consisting of a pylon clip, a conductor clip attached to a rod, and an earth cable electrically connecting those two parts. Afterwards one attaches the pylon clip to an earth contact applied on the pylon. Then one applies the conductor clip to the conductor with the help of the rod.

A disadvantage of this method is that at least two people are needed to execute this method. A further disadvantage is that it is a cumbersome and heavy job to apply the conductor clip to the conductor from underneath.

The object of the present invention is to provide an easy method for earthing a conductor without the need for a second person.

This object is achieved by lowering the earth clip from above unto the conductor to be earthed by means of a connecting element.

For this method a conductor clip is used which is so light and so less voluminous that this conductor clip, together with the accompanying earth cable and pylon clip can be carried up easily by a single person when climbing up. One climbs until in the girder above the conductor to be earthed and one lowers the conductor clip unto the conductor until the conductor clip tightens itself around the conductor to be earthed.

With the conductor clip known from the French specification No. 875 997 the weight of the rod is used to supply tightening force to tighten the clip unto the conductor.

So as to be able to apply the method according to the invention, the conductor clip used should be light in weight, have a rather small volume and should tighten itself automatically to the conductor to be earthed when being lowered unto the conductor and should loosen itself automatically from the earthed conductor when being removed.

In order to meet the above requirements a conductor clip is supplied, wherein the tightening jaws are coupled with a spring supplying a force urging the jaws to the closed position.

When lowering the conductor clip the weight of the conductor clip keeps the conductor clip in its open position against the force of the tightening spring working through a lever system. The supporting of the conductor clip on the conductor cancels this effect.

Further characteristics of a preferred embodiment of the invention are disclosed as this description proceeds.

So as to assure a good tight contact between the conductor and the conductor clip the jaws attract each other as influenced by the magnetic forces induced by the current from the conductor to the earth cable.

Figure 2:
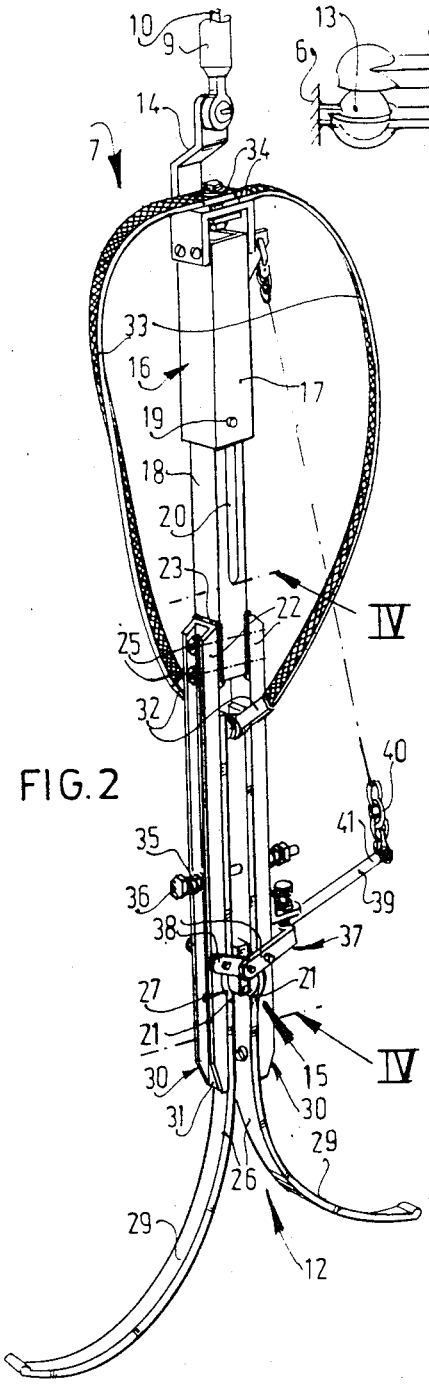
Figure 3:
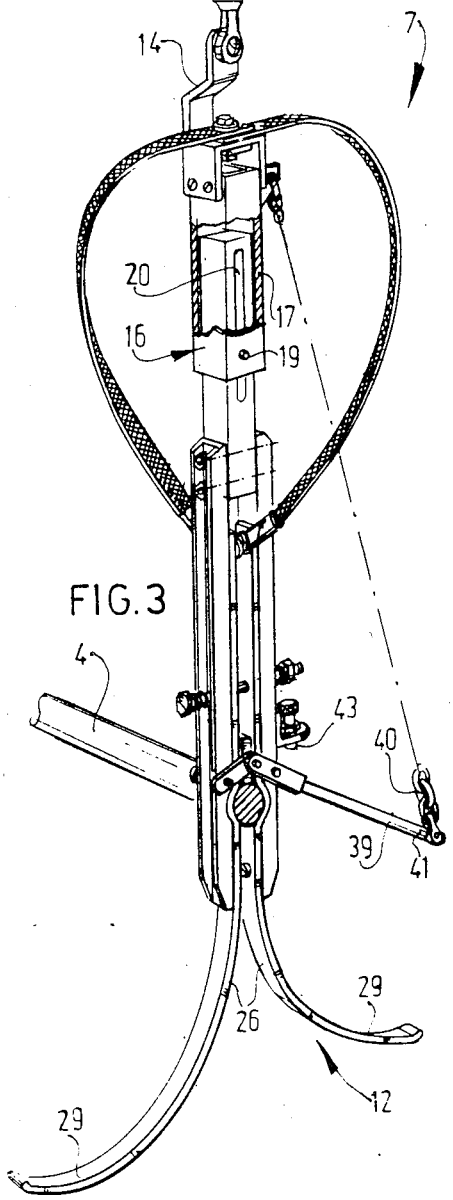
Figure 4:
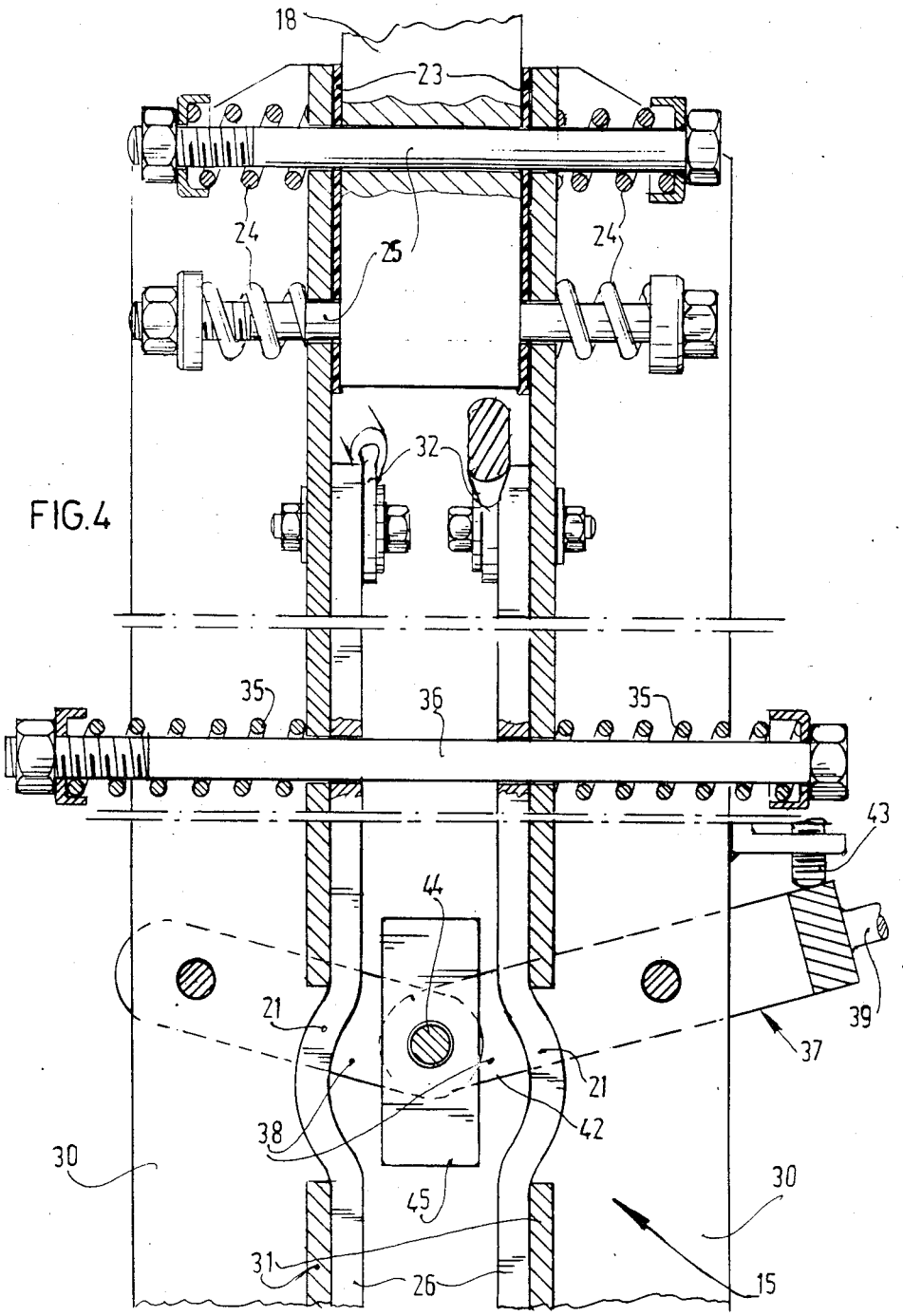

The invention will be more clearly understood by means of the following description referring to the accompanying drawings in which are depicted:

FIG. 1: a perspective view of the supporting construction during performance of the method according to the invention;

FIGS. 2 and 3: a perspective view, partially broken away of the apparatus according to the invention, in respectively open and closed position; and FIG. 4: a section of FIG. 2 along the line IV—IV on a larger scale.

When performing the method according to the present invention one climbs into the suspension construction, i.e. a high voltage pylon or a high voltage portal, while carrying up an apparatus 7 according to the present invention, until a higher level 2 than the level 3 of the conductor 4 to be earthed. The conductor 4 is a high voltage cable of e.g. 10–400 kV suspended to a girder 6 of a pylon 8 by means of an insulator chain 5.

The apparatus 7 carried along comprises an earth cable 10 surrounded with an insulating material 9, a pylon clip 11 and conductor clip 12. Initially one connects the pylon clip 11 with an earth connector, embodied in an earth knob 13 on the suspension construction 1. Then the earth cable 10 is connected to the conductor 4 from above. The conductor clip 12 comprises suspension means 14 connected to the earth cable 10 and clamping means 15, connected to the suspension means 14 via a telescopic connection 16. The telescopic connection means 16 consists of a sleeve 17 rigidly connected to the suspension means 14 and a vertical rod 18 of which a slot 20 engages a transverse pin 19 of the sleeve 17 and functions as a stop means.

The clamping means 15 comprises two jaws 21 rotatably connected to the rod 18, under insertion of a strip of elastic material being clamped by means of springs 24, tensioned by bolts 25. The jaws 21 consist mainly of brass strips 26, adapted on the clamping spot to the shape and size of the conductor 4 or (as shown in the drawing) of a socket 28 clamped around the conductor 4 to be received by the conductor clip 12. The lower ends 29 of the strips 26 take the shape of outwardly bended legs, which facilitate the catching of a conductor 4. The strips 26 are attached to bodies 31 of U-profiles 30 and are connected through cablesockets 32 to flexible cables 33, which are connected to the suspension means 14 through cablesockets 34. The jaws 21 are urged to each other by means of helical spring 35, which are tensioned by means of a bolt 36.

The induced current runs from the clamped on conductor 4 through both strips 26 in equal amounts due to the same resistance and through the cables 33 to the earth cable 10. This induces a magnetic field urging the jaws to each other and applying an extra clamping force.

The conductor clip 12 comprises opening means 37, comprising two pairs of links 38 rotatably connected to each other and engaging the jaws 21. One pair of the links is rigidly connected with a lever 39 which is connected with the suspension means 14 through a flexible pull means 40 of a certain length, e.g. a chain. Thus the opening means 37 are operated by the weight of all clamping parts formed by all clamping means 15 to open the conductorclip 12. The end 41 of the lever 39 being held on a certain level with respect to the suspension means 14, and the weight of the clamping means 15 urging down the other end 42, the links 38 are being rotated until the position shown in FIG. 2, where they are held up by a stop 43 consisting of a adjustment bolt, held by a profile.

In this opened position the links are in the stable position, as they have been rotated over the dead lock.

A hinge pin 44 connecting the links 38 carries suspension means to suspend the clamping means 15 on the conductor 4.

When the conductor clip 12 is being put onto a conductor 4 (respectively a socket 28), the conductor clip is being lowered from above onto the conductor 4 until the rod 45 in being held by the conductor 4 and the weight of the clamping means 15 is being suspended on the conductor 4. Then the links 38 and the lever 39 are rotated until the closed position shown in FIG. 3.

I claim:

1. A clamp assembly for effecting the earthing of high voltage electrical conductors, comprising the combination of:

an upper part adapted to be electrically connected to an earthing cable;

a lower part movably carried by said upper part for lowered disposition relative thereto due to the weight of said lower part, said lower part terminating at its lower end in jaw means for clamping a high voltage conductor and including mechanism for movably urging said jaw means to closed position, opening means responsive to the lowered disposition of said lower part relative to the upper part for maintaining said jaw means in open position in opposition to said mechanism so as to receive the high voltage conductor therebetween said including structure adapted to bear upon the high voltage conductor under the weight of the clamp assembly to permit said mechanism to urge the jaw means into closing position on the high voltage conductor.

2. A clamp assembly as defined in claim 1 wherein said opening means comprises linkage urged to over center condition by the lowered disposition of said lower part.

3. A clamp assembly as defined in claim 2 wherein said jaw means presents clamping surfaces for the high voltage conductor and said structure comprises a portion of said linkage located adjacent said clamping surfaces and movable by the high voltage conductor entering between such clamping surfaces to release the over center condition of said linkage.

4. A clamp assembly as defined in claim 1 wherein said jaw means comprising a pair of elongate jaw members disposed in generally parallel relation and each jaw member including means for magnetically urging the jaw members toward each other when electrical connection is made between the jaw members and the high voltage conductor.

5. A clamp assembly as defined in claim 1 wherein said upper and lower parts and telecopically interfitted and include stop means for arresting the lower part in its lowered disposition relative to the upper part.

6. A clamp assembly as defined in claim 5 including flexible conductor means for electrically connecting said jaw means to the upper part.

7. The method for earthing a conductor suspended in the air by a supporting construction which comprises the steps of first connecting an earth cable with an earth contact on the supporting construction and subsequently earthing the conductor to be earthed through the earth cable by means of an earth clip wherein the earth clip tighteningly engages the conductor by means of tightening jaws in the earthing position and wherein the tightening jaws keep the earth clip open in the non-earthing position as a consequence of the weight of at least a part of the earth clip, and including the step of suspending the earth clip from the earth cable and lowering the earth clip by means of the earth cable onto the conductor.

8. The method of earthing an elevated high voltage electrical conductor carried by a support structure, which comprises the steps of:

(a) earthing an electrical clamp and manually transporting the earthed electrical clamp on the support structure to a position above the high voltage electrical conductor;

(b) maintaining the earthed electrical clamp in open position by manually suspending the weight of the earthed electrical clamp from the position on the support structure above the high voltage electrical conductor;

(c) manually lowering the earthed, open electrical clamp toward the high voltage conductor; and (d) closing the electrical clamp on the high voltage conductor to establish earthed electrical contact therewith by continuing step (c) until at least part of the weight of the electrical clamp rests upon the high voltage conductor.

9. The method as defined in claim 8 wherein step (d) is effected by mechanically closing the electrical clamp in response to predetermined weight of the electrical clamp resting upon the high voltage conductor.

10. The method as defined in claim 9 wherein step (d) is also effected by magnetically urging the electrical clamp against the high voltage conductor in response to electrical contact of the electrical clamp with the high voltage conductor.

* * * * *